US008836711B2

(12) United States Patent
Hsieh

(10) Patent No.: US 8,836,711 B2
(45) Date of Patent: Sep. 16, 2014

(54) METHOD FOR DISPLAYING DIVIDED SCREENS ON A DISPLAY AND ELECTRONIC DEVICE APPLYING THE METHOD

(75) Inventor: I-Pin Hsieh, Taipei Hsien (TW)

(73) Assignee: Wistron Corporation, Taipei Hsien (TW)

( * ) Notice: Subject to any disclaimer, the term of this patent is extended or adjusted under 35 U.S.C. 154(b) by 723 days.

(21) Appl. No.: 12/395,925

(22) Filed: Mar. 2, 2009

(65) Prior Publication Data

US 2010/0045689 A1 Feb. 25, 2010

(30) Foreign Application Priority Data

Aug. 19, 2008 (TW) ..... 97131544 A

(51) Int. Cl.

| | |
|---|---|
| ***G09G 5/36*** | (2006.01) |
| ***G09G 5/397*** | (2006.01) |
| ***G09G 5/393*** | (2006.01) |
| *G09G 5/391* | (2006.01) |

(52) U.S. Cl.

CPC ..... *G09G 5/393* (2013.01); *G09G 5/391* (2013.01); *G09G 2310/0221* (2013.01); *G09G 2370/027* (2013.01)

USPC ..... 345/545; 345/546; 345/547

(58) Field of Classification Search

CPC combination set(s) only.

See application file for complete search history.

(56) References Cited

U.S. PATENT DOCUMENTS

| | | | | |
|---|---|---|---|---|
| 4,831,494 | A | 5/1989 | Arnold et al. | |
| 6,152,739 | A * | 11/2000 | Amery et al. | 434/38 |
| 6,646,647 | B1 * | 11/2003 | Surgutchik et al. | 345/581 |
| 7,260,717 | B2 | 8/2007 | Liu | |
| 2001/0005433 | A1 | 6/2001 | Takiguchi | |
| 2003/0156188 | A1 * | 8/2003 | Abrams, Jr. | 348/51 |
| 2003/0190158 | A1 | 10/2003 | Roth et al. | |
| 2005/0156948 | A1 * | 7/2005 | Hunt | 345/648 |
| 2007/0166671 | A1 * | 7/2007 | Walter | 434/98 |
| 2007/0250867 | A1 * | 10/2007 | Kuwabara et al. | 725/75 |

(Continued)

FOREIGN PATENT DOCUMENTS

| | | |
|---|---|---|
| JP | 08-256315 | 10/1996 |
| JP | 09-026769 | 1/1997 |

(Continued)

OTHER PUBLICATIONS

Office Action for Taiwanese Application No. 097131544 Dated Apr. 16, 2013, 9 pgs.

(Continued)

*Primary Examiner* — Kee M Tung
*Assistant Examiner* — Leon T Cain, II
(74) *Attorney, Agent, or Firm* — Amin, Turocy & Watson, LLP

(57) ABSTRACT

An electronic device has a display, a video memory, a video data buffer unit, a central processing unit, and a video processing unit. The central processing unit, according to a number of divided screens and a resolution for each of the divided screens, retrieves different but continuous video data corresponding to the resolution of each of the divided screens from the video data buffer unit, and stores the retrieved continuous video data in consecutive memory addresses in the video memory. The video processing unit reads in sequence the continuous video data stored in the video memory, and sends the continuous video data in sequence to the display according to a direction of arrangement of the divided screens such that video contents displayed on the divided screens by the display are continuous.

7 Claims, 5 Drawing Sheets

(56) References Cited

U.S. PATENT DOCUMENTS

| | | | | |
|---|---|---|---|---|
| 2007/0252797 | A1 | 11/2007 | Huang et al. | |
| 2008/0066111 | A1* | 3/2008 | Ellis et al. | 725/57 |
| 2008/0192141 | A1 | 8/2008 | Aoki | |
| 2008/0196068 | A1 | 8/2008 | Tseng | |
| 2009/0258697 | A1* | 10/2009 | Kelly et al. | 463/20 |
| 2010/0045689 | A1* | 2/2010 | Hsieh | 345/545 |
| 2010/0333017 | A1* | 12/2010 | Ortiz | 715/800 |

FOREIGN PATENT DOCUMENTS

| | | |
|---|---|---|
| JP | 09-84050 | 3/1997 |
| JP | 2006-38996 | 2/2006 |
| TW | 326091 | 8/2003 |
| TW | 200307256 | 12/2003 |
| TW | I249946 | 2/2006 |
| TW | 200741617 | 11/2007 |
| TW | 200835320 | 8/2008 |

OTHER PUBLICATIONS

Chinese Office Action for Chinese Application No. 200810146959.0 issued Nov. 23, 2011.

Japanese Office Action for Application No. 2009-176399 dated Sep. 6, 2011.

Chinese Office Action dated Jan. 26, 2011 corresponding to U.S. Appl. No. 12/395,925, filed Mar. 2, 2009.

TW Office Action dated Oct. 31, 2012 for TW application No. 097131544, with translation, 8 pages.

* cited by examiner

METHOD FOR DISPLAYING DIVIDED SCREENS ON A DISPLAY AND ELECTRONIC DEVICE APPLYING THE METHOD

CROSS-REFERENCE TO RELATED APPLICATION

This application claims priority of Taiwanese Application No. 097131544, filed on Aug. 19, 2008.

BACKGROUND OF THE INVENTION

1. Field of the Invention

The invention relates to a method for displaying on a screen of a display, more particularly to a method for dividing a screen of a display, and an electronic device applying the method.

2. Description of the Related Art

A notebook computer of the latest generation differs from a conventional notebook computer in the size and resolution of the liquid crystal display thereof. The liquid crystal display of the conventional notebook computer generally has a resolution of 1024×768 pixels, whereas the latest notebook computer has a liquid crystal display with a resolution of 1600×600 pixels, providing users with a new way of using notebook computers. Because the latest widescreen liquid crystal display is wider from left to right and narrower from top to bottom and has a higher resolution, the pitch between two adjacent pixels is smaller compared to a conventional liquid crystal display, so that the displayed characters appear smaller, though finer. When a user browses a web page, the user may find it difficult or inconvenient to browse the web page or perform operations thereon since the characters in the web page are too small.

Therefore, if the screen of such a widescreen display which is wide from left to right and narrow from top to bottom can be divided in an appropriate manner, if the resolutions of the divided screens can be automatically adjusted to suitably enlarge the contents displayed thereon, and if the divided screens can be displayed continuously, the user will find it easy and convenient to view the displayed contents and to perform operations thereon when using such a widescreen display, which may help promote and popularize use of the widescreen display.

SUMMARY OF THE INVENTION

Therefore, an object of the present invention is to provide a method for displaying divided screens, in which contents displayed on the divided screens are continuous, and to provide an electronic device applying the method.

Accordingly, the method for displaying divided screens of the present invention includes: (a) parsing a divide screen command to determine a number of divided screens to be generated and a resolution for each of the divided screens; (b) according to the number of divided screens and the resolution for each of the divided screens, retrieving different but continuous video data that correspond to the resolution of each of the divided screens and storing the retrieved video data in consecutive memory addresses in a video memory; and (c) reading in sequence the continuous video data stored in the video memory and sending the continuous video data thus read in sequence to a display according to a direction of arrangement of the divided screens such that video contents displayed on the divided screens by the display are continuous.

Preferably, in step (a), a divided screen setting user interface is provided, in which a plurality of screen dividing modes are provided for setting by a user so as to generate the divide screen command, each of the modes defining the number of divided screens and the resolution for each of the divided screens.

An electronic device for implementing the aforesaid method of this invention includes: a display; a video memory; a video data buffer unit; a central processing unit which, according to a number of divided screens and a resolution of each of the divided screens, retrieves different but continuous video data that correspond to the resolution of each of the divided screens from the video data buffer unit, and stores the retrieved continuous video data in consecutive memory addresses in the video memory; and a video processing unit which reads, in sequence, the continuous video data stored in the video memory, and sends the continuous video data in sequence to the display according to a direction of arrangement of the divided screens such that video contents displayed on the divided screens by the display are continuous.

Preferably, the video data buffer unit is one of a hard disk and a main memory.

Preferably, the central processing unit is loaded with a divided screen setting application which is executed by the central processing unit to generate a divided screen setting user interface so as to provide a plurality of screen dividing modes for setting by a user. Each of the modes defines the number of divided screens and the resolution for each of the divided screens.

Preferably, the central processing unit is loaded with a video driver which, according to the screen dividing mode set via the divided screen setting user interface, retrieves the different but continuous video data corresponding to the resolution of each of the divided screens from the video data buffer unit and stores the retrieved continuous video data in the consecutive memory addresses in the video memory.

Preferably, the display is a widescreen liquid crystal display with a resolution of 1600×600.

Preferably, the electronic device is a notebook computer.

In the present invention, by means of the video driver which, according to the sizes and resolutions of the divided screens, retrieves video data corresponding to the resolution of each of the divided screens and which stores the retrieved video data in the video memory, and by means of the video processing unit which reads the video data in sequence from the video memory and sends the video data thus read to the liquid crystal display for displaying, the divided screens of the liquid crystal display can display continuous video contents so as to be able to display more video contents. At the same time, since the video driver can automatically adjust the resolutions of the divided screens depending on the sizes of the divided screens, the user can view the video contents in an appropriate manner, thereby facilitating the carrying out of various operations via the display screen.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
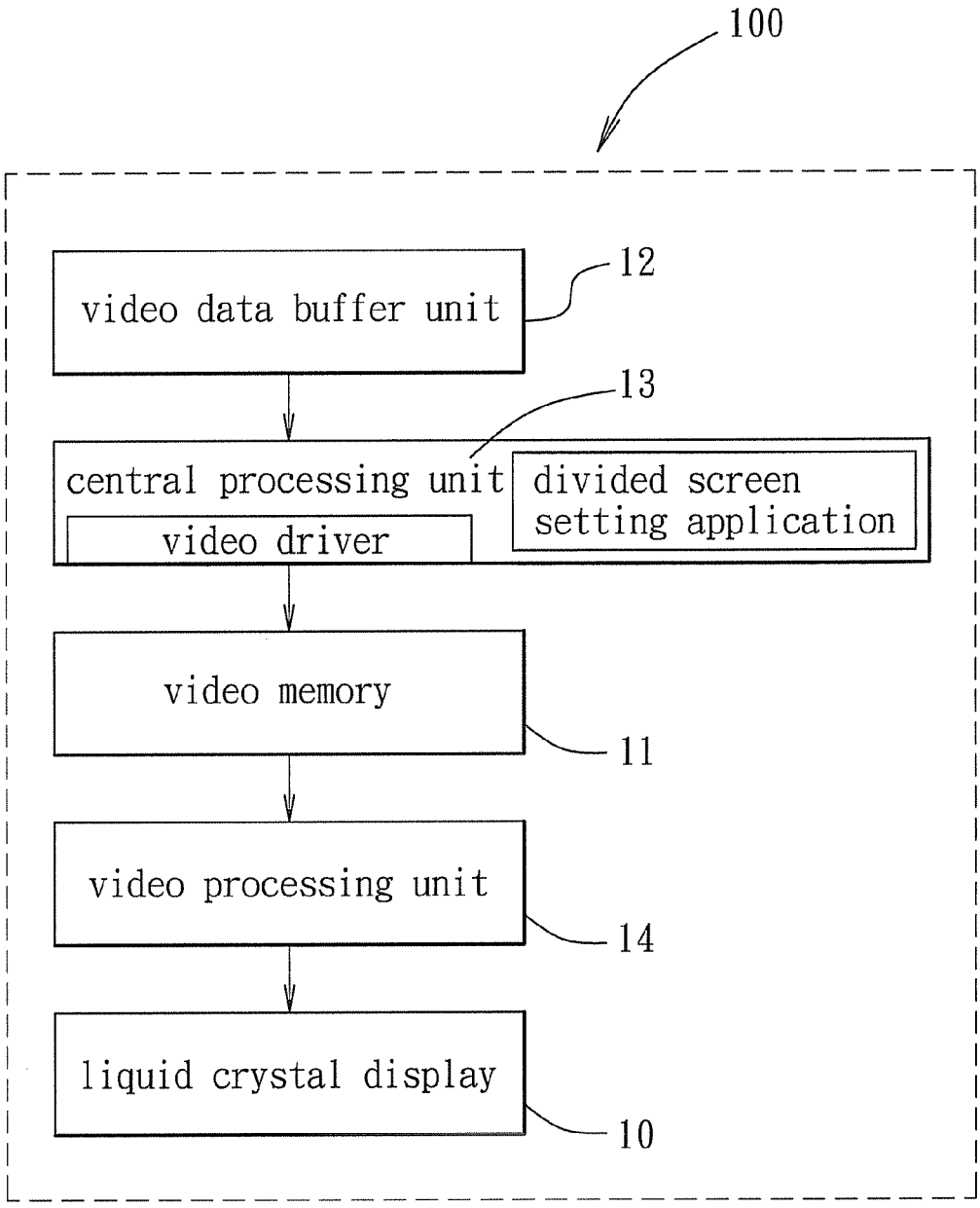
FIG. 1 is a circuit block diagram of a preferred embodiment of an electronic device according to the present invention.

FIG. 1 illustrates the preferred embodiment of an electronic device according to the present invention. The preferred embodiment of the electronic device is exemplified as a notebook computer 100 having a widescreen liquid crystal display 10 with a 1600×600 pixel array. FIG. 1 shows the main circuit blocks of the notebook computer 100 for controlling the liquid crystal display 10 to display divided screens on a display screen thereof, which include a video memory 11, a video data buffer unit 12, a central processing unit 13, and a video processing unit 14.

The video memory (video RAM, generally known as VRAM) 11 stores video (image) data that is to be sent to the liquid crystal display 10 for displaying.

The video data buffer unit 12 may be a main memory or hard disk, and stores source video (image) data temporarily.

The central processing unit 13 is loaded with a video driver and a divided screen setting application. When the divided screen setting application is executed, a divided screen setting user interface is generated on the liquid crystal display 10 for setting a number of screens the display screen is to be divided into by the user, i.e., setting a screen dividing mode. For example, a screen dividing mode 1 of setting the screen to be divided into two divided screens or a screen dividing mode 2 of setting the screen to be divided into three divided screens, etc. The video driver may suitably retrieve the video data from the video data buffer unit 12 and stores the retrieved video data in the video memory 11 at consecutive locations according to the screen dividing mode set by the user and resolutions to which divided screens respectively correspond. In other words, the video driver can retrieve consecutive video data that correspond to the resolution of each of the divided screens from the video data buffer unit 12 according to the number of the divided screens and the resolution of each of the divided screens, and stores the retrieved video data in the video memory 11 at consecutive memory addresses. Thus, the video processing unit 14 reads, in sequence, the consecutive video data stored in the video memory 11, and sends the same to the liquid crystal display 10 in sequence according to a direction of arrangement of the divided screens for displaying, so that continuous images (video) can be displayed on the divided screens. This will be explained in greater detail by way of an example.

Figure 2:
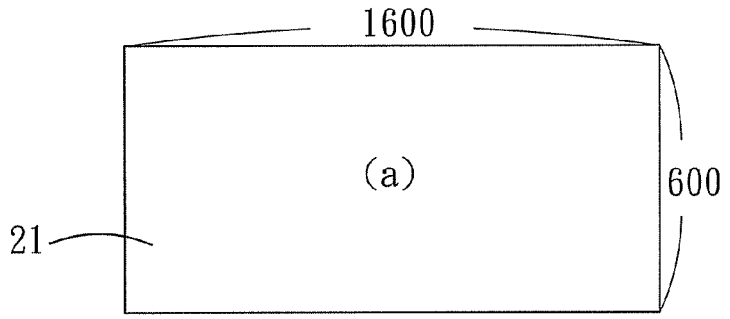
FIG. 2 is a schematic diagram illustrating a single screen of the preferred embodiment.
Figure 3:
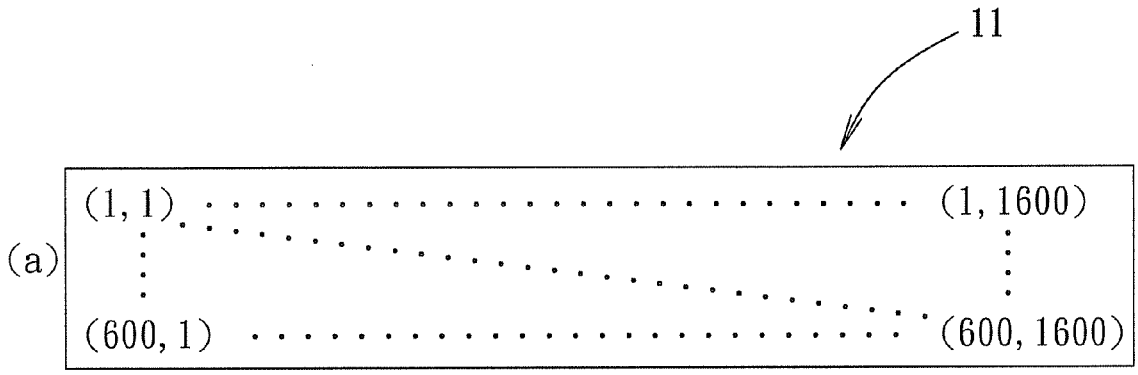
FIG. 3 is a schematic diagram to illustrate locations where video data for the single screen are stored in a video memory according to the preferred embodiment.

As shown in FIG. 2, since the resolution of the liquid crystal display 10 is 1600×600 pixels, when a single screen 21 is displayed, the video driver in the central processing unit 13 acquires 1600×600 entries of video data from the video data stored temporarily in the video data buffer unit 12, and stores the same in sequence in a memory block (a) of the video memory 11 as shown in FIG. 3. The acquired video data will be stored line by line and in sequence in the video memory 11 at addresses (1, 1)~(1, 1600), (2, 1)~(2, 1600), . . . (600, 1)~(600, 1600). Therefore, when the video processing unit 14 accesses the video memory 11, it will read the video data line by line and in sequence from the video memory 11 starting from the addresses (1, 1)~(1, 1600), (2, 1)~(2, 1600) . . . , and sends the video data read thereby to the liquid crystal display 10 for displaying. In other words, the video data stored at each of the memory addresses in the memory block (a) is displayed in a corresponding pixel of the liquid crystal display 10. Such is a way a screenful of information or image is displayed on a conventional liquid crystal display.

However, when a user is browsing a web page, since a web page occupies approximately 1280 (column) by 800 (row) pixels, a display generally requires an array of at least 1280 (column)×800 (row) pixels in order for the entire contents of the web page to be displayed. Since the liquid crystal display 10 of this embodiment has 600 pixels in the column direction, the contents of a web page cannot be entirely displayed on the screen. The user needs to move a scroll bar at one side of the screen up and down in order to be able to view the contents of the entire web page.

Figure 4:
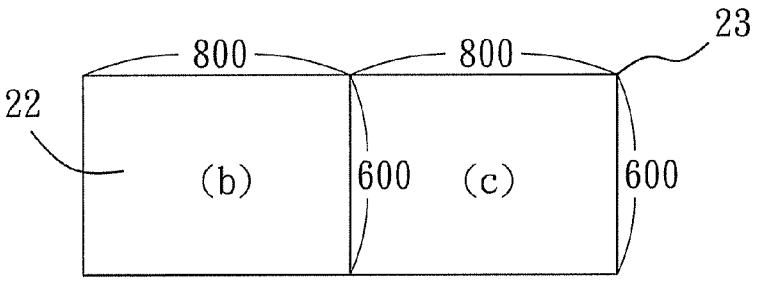
FIG. 4 is a schematic diagram to illustrate two divided screens according to the preferred embodiment.

Therefore, in this embodiment, if it is desired to display the entire contents of a web page on the liquid crystal display 10, the user can issue a divide screen command via the divided screen setting user interface, e.g., requesting the notebook computer 100 to display two equally divided screens 22, 23 on the liquid crystal display 10, as shown in FIG. 4. Since the liquid crystal display 10 is to display two divided screens 22, 23 of equal size, the resolution of each divided screen is only 800×600 pixels. Therefore, if it is desired to display an image (video) continuously in the divided screens 22, 23, i.e., the image (video) is displayed as two consecutive pages of data on the two divided screens 22, 23, the central processing unit 13 must rearrange the storage addresses of the video data in the video memory 11.

Figure 5:
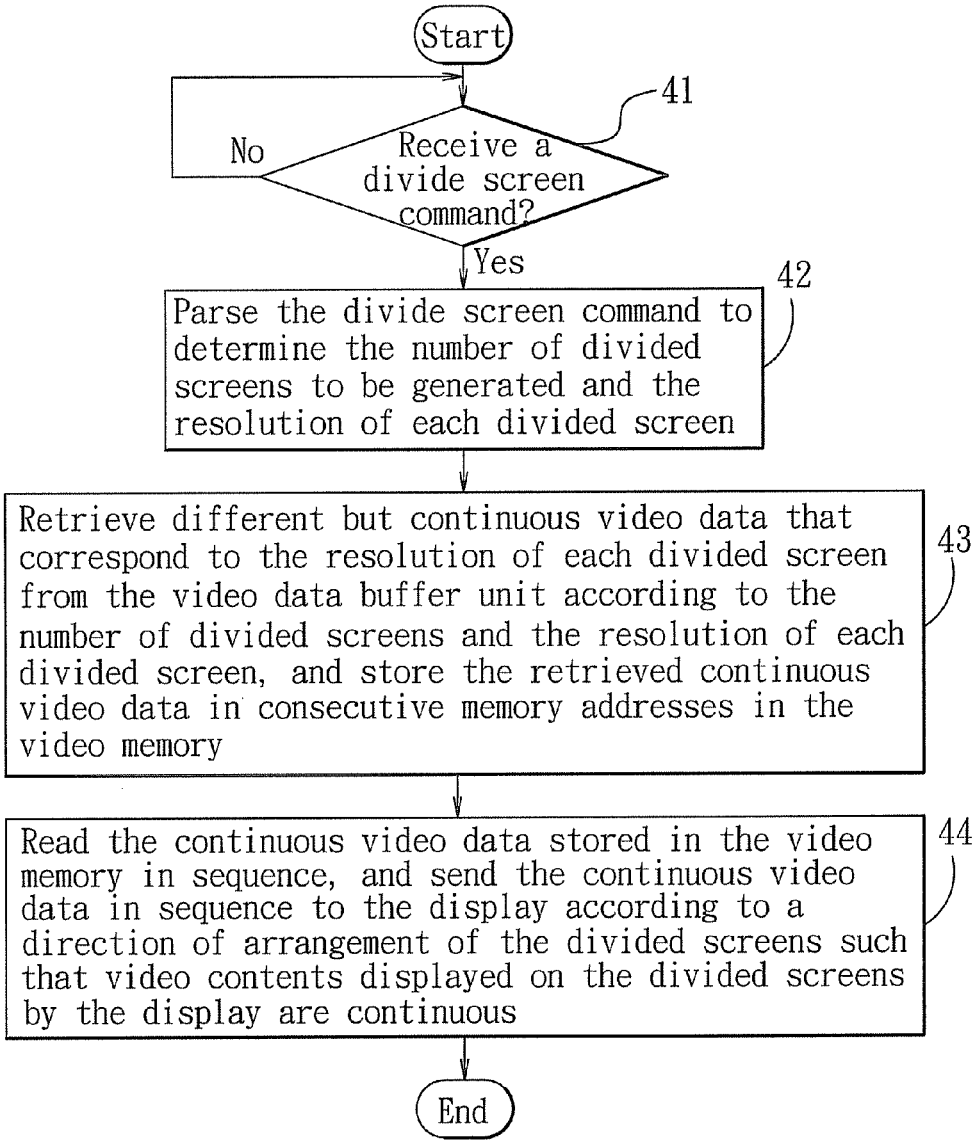
FIG. 5 is a flowchart to illustrate a preferred embodiment of a method for displaying divided screens according to the present invention.
Figure 6:
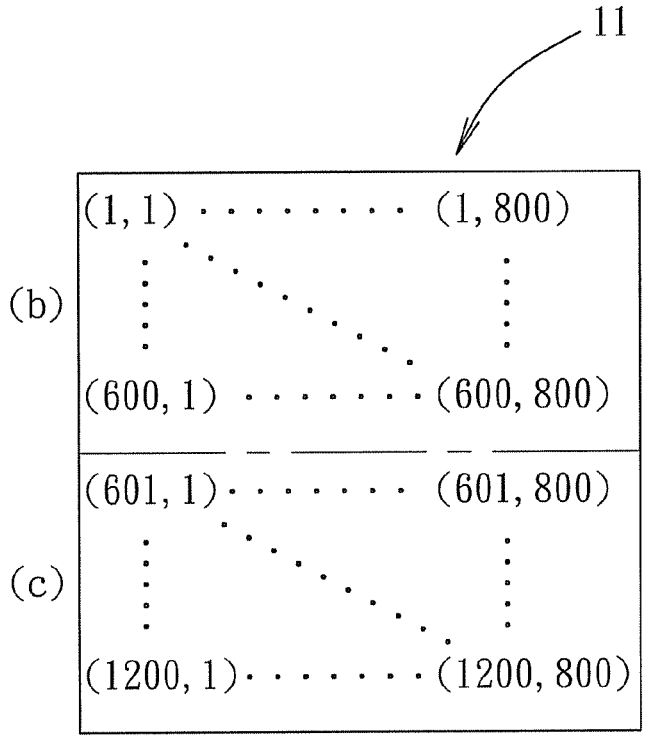
FIG. 6 is a schematic diagram to illustrate locations where video data for the two divided screens are stored in the video memory according to the preferred embodiment.

Therefore, referring further to FIG. 5 which illustrates the process of displaying divided screens, when the video driver of the central processing unit 13 receives a divide screen command in step 41, the video driver executes step 42 to parse the divide screen command so as to determine the number of divided screens to be generated and the resolution of each of the divided screens via the screen dividing mode set by the user, and subsequently executes step 43 to retrieve the video data from the video data buffer unit 12 once again depending on the number of the divided screens and the resolution of each of the divided screens. For example, while 1600 entries of video data are retrieved in the case of displaying the single screen 21 with 1600 pixels in each line, the video driver will only retrieve 800 entries of video data for each line of divided screen content from the video data buffer unit 12 and store the same in a row of memory addresses in the video memory 11, i.e., the data is stored at a total of only 800 addresses, e.g., (1, 1)~(1, 800), in each line in the video memory 11. Therefore, as shown in FIG. 6, content of the first divided screen 22 will occupy addresses (1, 1) to (600, 800) of a memory block (b) of the video memory 11, while content of the second divided screen 23 will occupy addresses (601, 1) to (1200, 800) of a memory block (c) of the video memory 11. In other words, the video data of the two divided screens 22, 23 are stored in sequence in two consecutive memory blocks (b) and (c) of the video memory 11.

Thus, in step 44, when the video processing unit 14 reads video data from the video memory 11, the video data in the memory block (b) will be read in sequence and displayed correspondingly on the divided screen 22 of the liquid crystal display 10, and the video data in the memory block (c) is subsequently read and displayed on the divided screen 23. Because the video data in the memory blocks (b) and (c) are successively displayed on the two divided screens 22, 23, when the user browses the web page, a portion of the web page that is not displayed on the divided screen 22 is displayed on the divided screen 23. In other words, since the two divided screens 22, 23 display continuous video data, the content of the image (video) displayed thereon is almost twice that displayed on the single screen 21.

Furthermore, since the two divided screens 22, 23 display continuous video data, when the video content in one of the divided screens 22, 23 is altered or edited, the content displayed on the other of the divided screens 22, 23 is synchronously updated.

Figure 7:
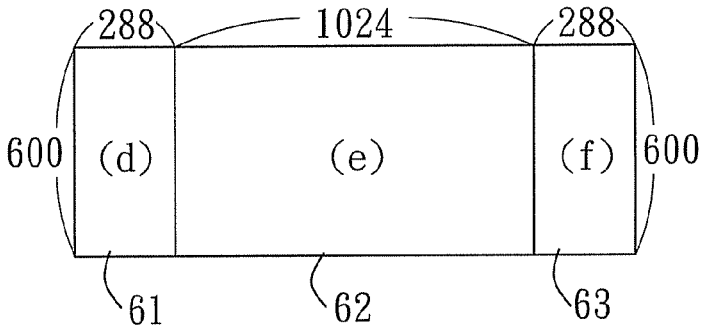
FIG. 7 is a schematic diagram to illustrate three divided screens according to the preferred embodiment.
Figure 8:
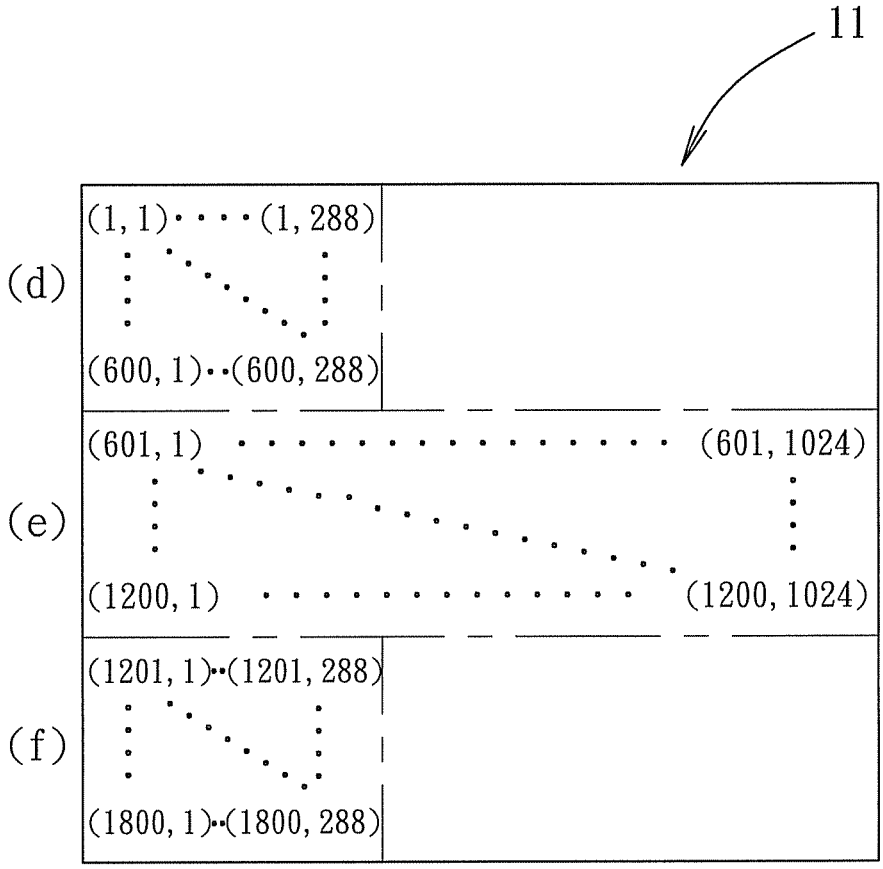
FIG. 8 is a schematic diagram to illustrate locations where video data for the three divided screens are stored in the video memory according to the preferred embodiment.

Similarly, referring to FIG. 7, when the user requests that the display screen be divided into three divided screens via the divided screen setting user interface, the video driver of the central processing unit 13 divides the display screen into two small left and right divided screens 61, 63 and a large middle divided screen 62. The resolution of each of the left and right divided screens 61, 63 is 288×600 pixels, and that of the middle divided screen 62 is 1024×600 pixels. Therefore, according to the different resolutions of the three divided screens 61, 62, 63, the video driver will retrieve, in succession, 288×600 entries of video data, 1024×600 entries of video data, and 288×600 entries of video data from the video data buffer unit 12 and store the same sequentially in three consecutive memory blocks (d), (e) and (f) of the video memory 11, as shown in FIG. 8. Therefore, when the video processing unit 14 reads video data from the video memory 11, it will read the video data stored in the memory blocks (d), (e), and (f) in sequence and send the video data read thereby to the liquid crystal display 10 for displaying on the divided screens 61, 62, 63, respectively. Since the middle divided screen 62 has a higher resolution, it is generally used as a main display area, so that the user can clearly view video content displayed on the middle divided screen 62. Since the left and right divided screens 61, 63 have a lower resolution, the video contents displayed thereon are roughly discernible. The contents on the three divided screens 61, 62, 63 are continuous, and may be edited. Moreover, options displayed in a web page presented on the divided screens are selectable.

Although the present invention has been exemplified as a notebook computer with a widescreen display, it can be implemented in a flat panel display of a conventional desktop computer, and is not limited to the preferred embodiment described herein.

In addition, the preferred embodiment is not limited to the screen dividing modes of dividing a screen into two and three divided screens as described hereinabove. Manufacturers of notebook computers or desktop computers may design other screen dividing modes according to user requirements so as to provide users with better displaying effects.

As illustrated, in the preferred embodiment, by means of the video driver which, according to the sizes and resolutions of the divided screens, retrieves video data corresponding to the resolution of each of the divided screens and stores the retrieved video data in the video memory 11, and by means of the video processing unit 14 which reads the video data in sequence from the video memory 11 and sends the video data thus read to the liquid crystal display 10 for displaying, the divided screens of the liquid crystal display 10 can display continuous video contents, so that the liquid crystal display 10 can display more video contents. At the same time, since the video driver can automatically adjust the resolutions of the divided screens depending on the sizes of the divided screens, the user can view the video contents in an appropriate manner, thereby facilitating the carrying out of various operations via the display screen.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. An electronic device comprising:

a display;

a video memory;

a video data buffer unit;

a central processing unit which, parses a divide screen command to determine a number of divided screens on a display screen of said display and a resolution of each of the divided screens, retrieves different but continuous video data that correspond to the resolutions of the divided screens from said video data buffer unit according to the number of the divided screens and the resolution of each of the divided screens, and stores the retrieved continuous video data in consecutive memory addresses in said video memory; and a video processing unit which reads, in sequence, the continuous video data stored in said video memory, and sends the continuous video data in sequence to said display according to a direction of arrangement of the divided screens such that consecutive portions of video content corresponding to the continuous video data are displayed on the divided screens.

2. The electronic device according to claim 1, wherein said video data buffer unit is one of a hard disk and a main memory.

3. The electronic device according to claim 1, wherein said central processing unit is loaded with a divided screen setting application which is executed by said central processing unit to generate a divided screen setting user interface so as to provide a plurality of screen dividing modes for setting by a user, each of the modes defining the number of divided screens and the resolution for each of the divided screens.

4. The electronic device according to claim 3, wherein said central processing unit is loaded with a video driver which, according to the screen dividing mode set via the divided screen setting user interface, retrieves the different but continuous video data corresponding to the resolution of each of the divided screens from said video data buffer unit and stores the retrieved continuous video data in the consecutive memory addresses in said video memory.

5. The electronic device according to claim 1, wherein said electronic device is a notebook computer.

6. A method for displaying divided screens on a display, comprising:

(a) parsing a divide screen command to determine a number of divided screens desired to be generated on a display screen of the display and a resolution for each of the divided screens;

(b) according to the number of divided screens and the resolution for each of the divided screens, retrieving different but continuous video data that corresponds to the resolutions of the divided screens and storing the retrieved video data in consecutive memory addresses in a video memory; and (c) reading in sequence the continuous video data stored in the video memory and sending the continuous video data thus read in sequence to a display according to a direction of arrangement of the divided screens such that consecutive portions of video content corresponding to the continuous video data are displayed on the divided screens.

7. The method for displaying divided screens on a display according to claim 6, wherein, in step (a), a divided screen setting user interface is provided, in which a plurality of screen dividing modes are provided for setting by a user so as to generate the divide screen command, each of the modes defining the number of divided screens and the resolution for each of the divided screens.

* * * * *